US009631306B2

(12) United States Patent
Shomura

(10) Patent No.: US 9,631,306 B2
(45) Date of Patent: Apr. 25, 2017

(54) PRESSER FOOT FOR SEWING MACHINE

(71) Applicant: Janome Sewing Machine Co., Ltd., Tokyo (JP)

(72) Inventor: Eiichi Shomura, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 14/972,356

(22) Filed: Dec. 17, 2015

(65) Prior Publication Data

US 2016/0258094 A1 Sep. 8, 2016

(30) Foreign Application Priority Data

Mar. 6, 2015 (JP) ..... 2015-044192

(51) Int. Cl.

| | |
|---|---|
| ***D05B 29/08*** | (2006.01) |
| ***D05B 35/06*** | (2006.01) |
| ***D05B 29/06*** | (2006.01) |
| ***D05B 35/10*** | (2006.01) |

(52) U.S. Cl.

CPC ..... *D05B 29/08* (2013.01); *D05B 29/06* (2013.01); *D05B 35/06* (2013.01); *D05B 35/10* (2013.01)

(58) Field of Classification Search

CPC ..... D05B 29/06

USPC ..... 112/151, 235, 240, 475.03

See application file for complete search history.

(56) References Cited

U.S. PATENT DOCUMENTS

| | | | | | |
|---|---|---|---|---|---|
| 2,653,559 | A * | 9/1953 | Picucci | D05B 35/06 | 112/151 |
| 2,706,456 | A * | 4/1955 | Stangler | D05B 35/06 | 112/152 |
| 3,511,201 | A * | 5/1970 | Howell | D05B 3/18 | 112/240 |
| 4,343,249 | A * | 8/1982 | Takenoya | D05B 3/24 | 112/314 |
| 4,494,471 | A * | 1/1985 | Zylbert | D05B 29/06 | 112/235 |
| 4,892,047 | A * | 1/1990 | Fieschi | D05B 29/06 | 112/122 |
| 5,054,407 | A * | 10/1991 | Rowley | D05B 29/00 | 112/136 |

(Continued)

FOREIGN PATENT DOCUMENTS

| | | | | |
|---|---|---|---|---|
| DE | GB 2256205 A | * | 12/1992 | D05B 29/06 |
| JP | H07-272 U | | 1/1995 | |
| JP | H08-309061 A | | 11/1996 | |

*Primary Examiner* — Tejash Patel

(74) *Attorney, Agent, or Firm* — Nakanishi IP Associates, LLC

(57) ABSTRACT

A presser foot of a sewing machine includes: a presser main body that presses a cloth; a guide base provided to the presser main body so as to form a single unit, and configured to guide a ribbon to be sewn to the cloth; a right guide and a left guide configured as members that are provided such that they can be relatively moved with respect to the guide base, that guide a position of the ribbon in the width direction, and that are arranged symmetrically with a position at which a sewing needle moves in a vertical direction as a base position; and an adjustment screw, a right guide bush, and a left guide bush, configured as a linking portion that links the movements of the right guide and the left guide such that they are positioned symmetrically with respect to the base position at all times.

3 Claims, 6 Drawing Sheets

(56) References Cited

U.S. PATENT DOCUMENTS 6,745,711 B1 * 6/2004 Martelli ..... D05B 29/08
112/151

* cited by examiner

PRESSER FOOT FOR SEWING MACHINE

CROSS REFERENCE TO RELATED APPLICATIONS

This application is based on and claims the benefit of priority to Japanese Patent Application No. 2015-044192 filed on Mar. 6, 2015, the contents of which are hereby incorporated by reference in their entirety.

BACKGROUND OF THE INVENTION

1. Field of the Invention

The present invention relates to a presser foot for a sewing machine.

2. Description of the Related Art

In a case in which a long, thin band-shaped (tape-shaped) member such as lace, a ribbon, a rubber band, or the like is sewn as a decoration member or a reinforcement member to a sewing target object such as a cloth or the like, there is a need to hold the band-shaped member and such a sewing target object so as to prevent them from jolting out of alignment.

Patent document 1 discloses a presser foot with a tape guide member included in a sewing machine that provides tape sewing. With such a presser foot with a tape guide member disclosed in Patent document 1, by guiding a tape to a predetermined position, such an arrangement is capable of sewing the tape to a sewing target object with high positioning precision.

RELATED ART DOCUMENTS

Patent Documents

Patent Document 1

Japanese Patent Application Laid-Open No. H08-309061

SUMMARY OF THE INVENTION

However, with such an apparatus disclosed in Patent document 1, every time the width of a tape (band-shaped member) used for sewing is changed, there is a need to loosen a clamp screw and to tighten the screw again after the tape guide member is adjusted according to the tape width. In addition, in a case in which the width of the tape changes, the center of the tape also changes with respect to the needle position. Accordingly, such an arrangement requires a positioning operation in which centering of the tape is performed again. Such a positioning operation requires the user to loosen the clamp screw. As described above, such an apparatus disclosed in Patent document 1 requires the user to perform an adjustment operation multiple times. This requires the user to loosen and tighten the screw for every adjustment operation, which is troublesome.

One or more embodiments according to the present invention provide a presser foot of a sewing machine having a function of adjusting the guiding width in a simple manner according to the width of a band-shaped member to be used, without a need to perform centering adjustment of the band-shaped member with respect to the needle position.

Embodiment 1

One or more embodiments of the present invention relate to a presser foot for a sewing machine. The presser foot comprises: a presser main body that presses a sewing target object; a guide base provided to the presser main body so as to form a single unit, and configured to guide a band-shaped member to be sewn to the sewing target object; guide members configured as a pair of members that are provided such that they can be relatively moved with respect to the guide base, that guide a position of the band-shaped member in a width direction, and that are arranged symmetrically with a position at which a sewing needle moves in a vertical direction as a base position; and a linking portion that links movements of the guide members such that they are positioned symmetrically with respect to the base position.

Embodiment 2

One or more embodiments of the present invention relate to the presser foot for a sewing machine according to the aforementioned embodiment 1. With such an embodiment, the linking portion comprises: a male screw member configured such that a right male screw is formed in one end thereof, and such that a left male screw is formed in the other end thereof; a right female screw provided to one of the guide members, and configured to be joined to the right male screw; and a left female screw provided to the other one of the guide members, and configured to be joined to the left male screw.

Embodiment 3

One or more embodiments of the present invention relate to the presser foot for a sewing machine according to the aforementioned embodiment 2. With such an embodiment, the right female screw and the left female screw are each configured as a component separate from the guide members, i.e., as a separate female screw member. Furthermore, each female screw member is applied to the corresponding guide member so as to form a single unit, thereby providing the right female screw and the left female screw to the corresponding guide members.

Advantages

With one or more embodiments according to the present invention, such an arrangement allows the presser foot of a sewing machine to adjust the guiding width in a simple manner according to the width of a band-shaped member to be used. In addition, such an arrangement requires no centering adjustment of the band-shaped member with respect to the needle position.

DESCRIPTION OF THE PREFERRED EMBODIMENTS

Description will be made with reference to the drawings and the like regarding a best mode for carrying out the present invention.

Embodiment

Figure 1:
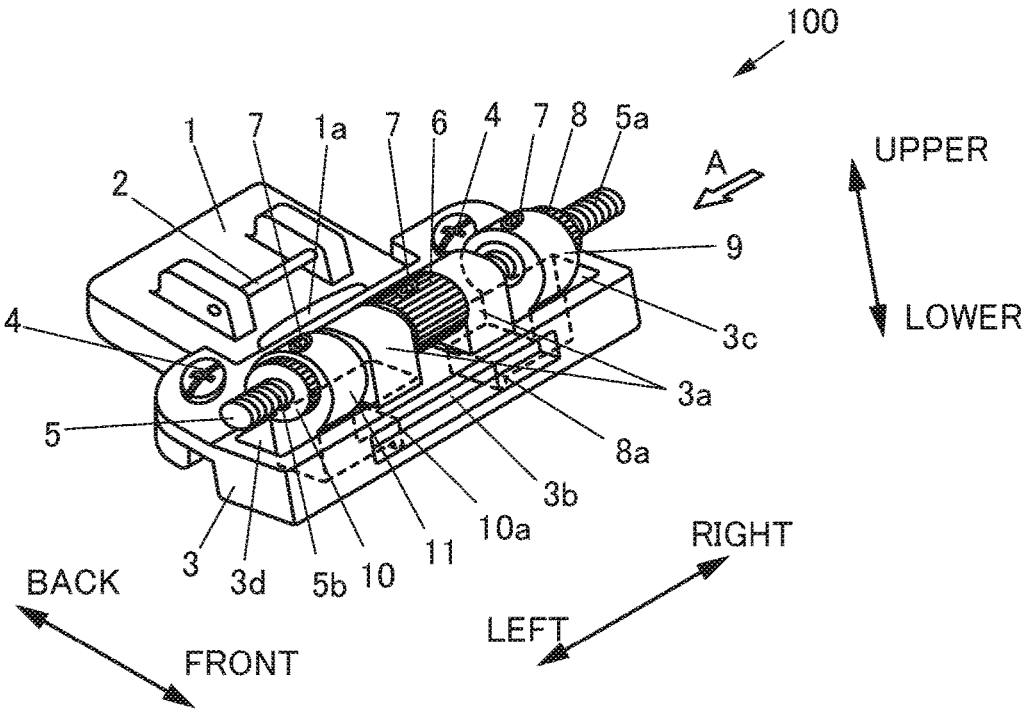
FIG. 1 is a perspective view showing an embodiment of a presser foot 100 of a sewing machine according to the present invention.
Figure 2:
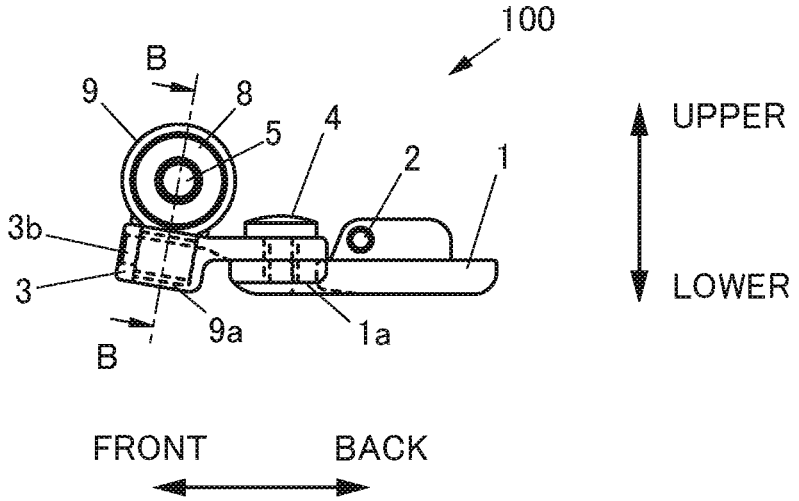
FIG. 2 is a diagram showing the presser foot 100 of the sewing machine as viewed from the direction indicated by the arrow A shown in FIG. 1.
Figure 3:
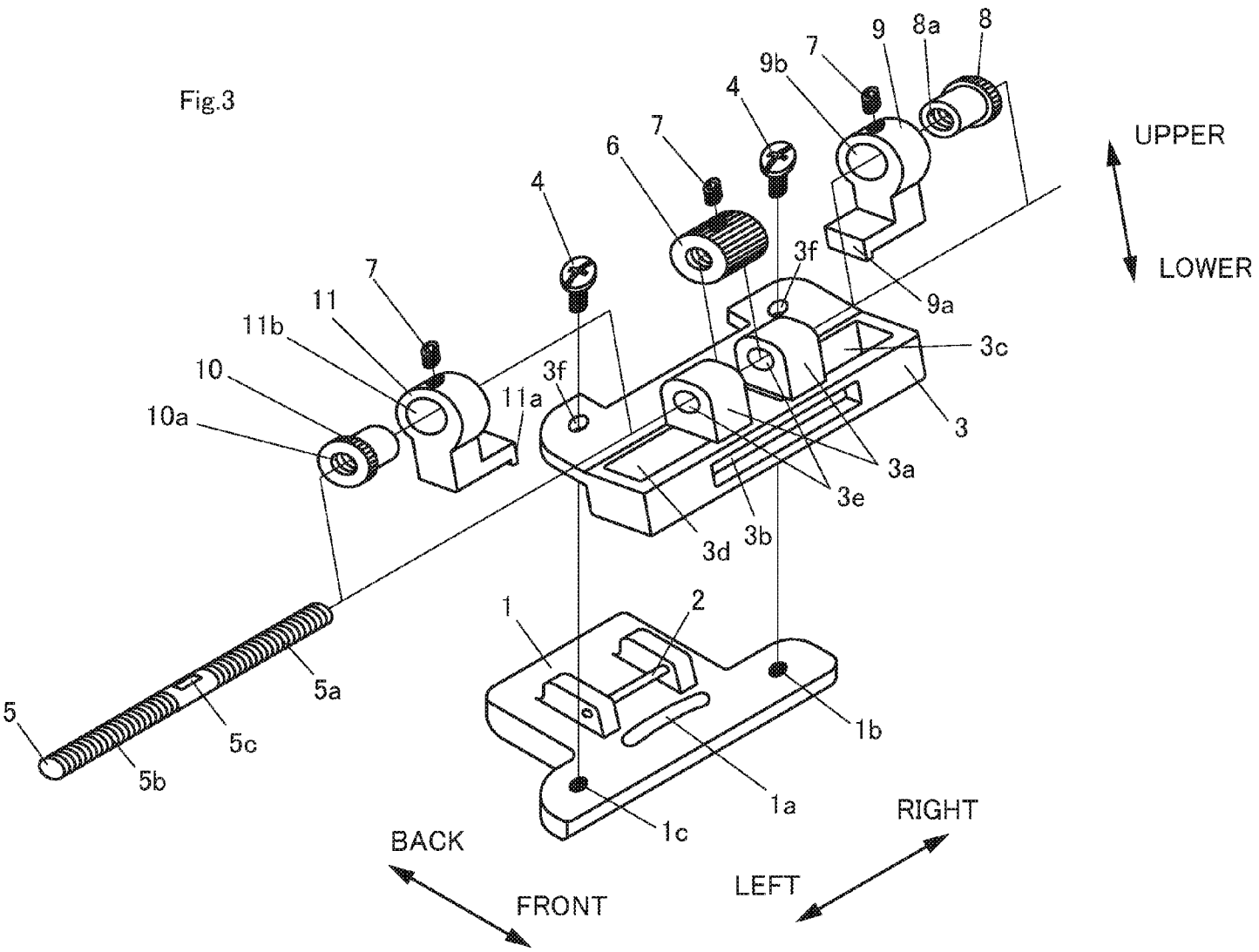
FIG. 3 is an exploded perspective view showing a component configuration of the presser foot 100 of the sewing machine.

FIG. 1 is a perspective view showing an embodiment of a presser foot 100 of a sewing machine according to the present invention. FIG. 2 is a diagram showing the presser foot 100 of the sewing machine as viewed from the direction indicated by the arrow A shown in FIG. 1. FIG. 3 is an exploded perspective view showing a component configuration of the presser foot 100 of the sewing machine.

It should be noted that the following drawings including FIGS. 1 through 3 each show a schematic configuration. For ease of understanding, each component is shown with a different size or different shape as appropriate.

Also, description will be made below regarding an arrangement with specific values, shapes, materials, etc. However, such factors may be changed as appropriate.

Also, for ease of understanding and for convenience of description, description will be made as appropriate using six directions, i.e., the front side, back side, left side, right side, upper side, and lower side, as indicated by the arrows in the drawings. However, such directions by no means restrict the configuration of the invention.

The presser foot 100 includes a presser main body 1, a pin 2, a guide base 3, an adjustment screw 5, an operation ring 6, a right guide bush 8, a right guide 9, a left guide bush 10, and a left guide 11.

The presser main body 1 has a function for pressing a sewing target object such as a cloth or the like in the sewing operation. In particular, in addition to pressing such a cloth or the like, the presser main body 1 according to the present embodiment presses, from the upper side, a ribbon to be sewn to a cloth or the like in a state in which it is guided in the left-right direction by means of the right guide and the left guide 11 as described later. With such an arrangement, the presser main body 1 holds a ribbon (band-shaped member) and a sewing target object such as a cloth or the like with a suitable pressure with respect to a sewing needle 12 configured to be moved in the vertical direction, thereby providing appropriate sewing. In the sewing operation, the presser main body 1 appropriately holds the sewing target object which is fed by means of a feed dog arranged on the lower side of the sewing target object and configured to be moved in the vertical direction and in the front-back direction.

It should be noted that description will be made with a ribbon as a typical example of such a band-shaped member to be guided by the right guide 9 and the left guide 11. That is to say, description will be made regarding each component using the term "ribbon" for exemplary purposes. However, such a band-shaped member to be held by the presser foot 100 according to the present embodiment is not restricted to such a ribbon. Also, the presser foot 100 according to the present embodiment is applicable to other kinds of band-shaped members such as tape, lace, rubber bands, or the like, in the same way as the ribbon.

The presser main body 1 has a needle opening 1*a*. In the sewing operation, the needle 12 passes through the needle opening 1*a*. In order to fixedly mount the guide base 3, screw holes 1*b* and 1*c* are provided to the front side of the presser main body 1 such that they are each configured as a hole extending in the vertical direction.

A pin 2 is provided to the rear side of the presser main body 1 such that it extends in the left-right direction. The pin 2 is fitted to a presser holder (not shown) so as to couple the presser main body 1 with a presser rod (not shown). It should be noted that the presser holder and the presser rod have the same structures as those included in a sewing machine according to a conventional known technique, and accordingly, detailed description thereof will be omitted.

The guide base 3 is fixed to the presser main body 1 by tightening screws 4 in screw holes 1*b* and 1*c* via openings 3*f* such that the guide base 3 is positioned closer to the front side than the needle opening 1*a* of the presser main body 1 and such that they are configured as a single unit. A pair of boss portions 3*a* are provided to the guide base 3 such that they are positioned roughly in the center thereof and such that they protrude toward the upper side. A through hole 3*e* is formed in each boss portion 3*a*, and is configured to rotatably hold an adjustment screw 5. A ribbon insertion window 3*b* configured as an opening is provided to the front end of the guide base 3. Furthermore, a groove 3*c* configured to hold the right guide 9 and a groove 3*d* configured to hold the left guide 11 are formed on the upper face of the guide base 3. The window 3*b* and the groove 3*c* are configured such that they communicate with each other in the interior of the guide base 3. Also, the window 3*b* and the groove 3*d* are configured such that they communicate with each other in the interior of the guide base 3.

The guide base 3 is provided with a guide member and a linking portion that form a guide mechanism configured to guide a ribbon. The guide members are arranged such that they can be relatively moved with respect to the guide base 3, and are configured as a pair of members that guide the position of a ribbon (band-shaped member) in the width direction. The guide members are arranged so as to be symmetrical with a position at which the sewing needle moves in the vertical direction as a base position. In the present embodiment, as such guide members, the right guide 9 and the left guide 11 are provided.

Moreover, the linking portion provides a function to link the movements of the guide members such that the guide members are arranged symmetrically at all times with respect to the base position. In the present embodiment, the linking portion is configured as a so-called feed screw mechanism including the adjustment screw 5, the right guide bush 8, and the left guide bush 10.

The adjustment screw (male screw member) 5 is mounted to the boss portions 3*a* such that it extends in the left-right direction, and such that it can be rotated with respect to the guide base 3. The adjustment screw 5 is configured such that a right male screw 5*a* is formed on its right side and a left male screw 5*b* is formed on its left side. The right male screw 5*a* and the left male screw 5*b* have the same parameters such as the nominal size, pitch, number of threads, and the like, except that the right male screw 5*a* is configured as a right screw and the left male screw 5*b* is configured as a left screw. A cut face 5*c* is formed in the central portion of the adjustment screw 5, which provides a face for receiving a screw 7 configured to fix the operation ring 6.

The operation ring 6 is fixed to a central portion of the adjustment screw 5 by means of the screw 7 such that it is interposed between the boss portions 3*a* of the guide base 3.

This allows the operation ring 6 to be rotated together with the adjustment screw 5 as a single unit.

The right guide bush (female screw member) 8 has a right female screw 8*a* configured such that the right male screw 5*a* can be fitted to it by screw engagement. The right guide bush 8 is inserted into a through hole 9*b* formed in the right guide 9. In this state, the right guide bush 8 is fixed to the right guide 9 by means of the screw 7 so as to form a single unit.

The right guide 9 has a guide portion 9*a* on its lower side, and has the through hole 9*b* on its upper side. The lower portion of the right guide 9 is arranged within the groove 3*c* of the guide base 3. The guide portion 9*a* is arranged such that it protrudes from the groove 3*c* toward the window 3*b* side (see FIG. 4 described later). Furthermore, with the right guide bush 8 fixed to the right guide 9, the right male screw 5*a* is fitted by screw engagement to the right female screw 8*a* of the right guide bush 8. Thus, by rotating the adjustment screw 5, such an arrangement is capable of moving the right guide 9 in the left-right direction according to the rotational direction of the adjustment screw 5.

The left guide bush (female screw member) 10 has a left female screw 10*a* configured such that the left male screw 5*b* can be fitted to it by screw engagement. The left guide bush is inserted into a through hole 11*b* formed in the left guide 11. In this state, the left guide bush 10 is fixed to the left guide 11 by means of the screw 7 so as to form a single unit.

The left guide 11 has a guide portion 11*a* on its lower side, and has the through hole 11*b* on its upper side. The lower portion of the left guide 11 is arranged within the groove 3*d* of the guide base 3. The guide portion 11*a* is arranged such that it protrudes from the groove 3*d* toward the window 3*b* side (see FIG. 4 described later). Furthermore, with the left guide bush 10 fixed to the left guide 11, the left male screw 5*b* is fitted by screw engagement to the left female screw 10*a* of the left guide bush 10. Thus, by rotating the adjustment screw 5, such an arrangement is capable of moving the left guide 11 in the left-right direction according to the rotational direction of the adjustment screw 5.

Here, the right guide 9 and the left guide 11 are arranged so as to be symmetrical, with a position at which the sewing needle 12 moves in the vertical direction as a base position.

As described above, the adjustment screw 5 is provided with the right male screw 5*a* and the left male screw 5*b*. The right male screw 5*a* is fitted by screw engagement to the right guide bush 8 such that the right guide bush 8 and the right guide 9 are arranged in the form of a single unit. Furthermore, the left male screw 5*b* is fitted by screw engagement to the left guide bush 10 such that the left guide bush 10 and the left guide 11 are arranged in the form of a single unit. Thus, by rotating the adjustment screw 5, such an arrangement is capable of symmetrically moving the right guide 9 and the left guide 11 in a direction such that the distance between them is increased or otherwise reduced.

Figure 4:
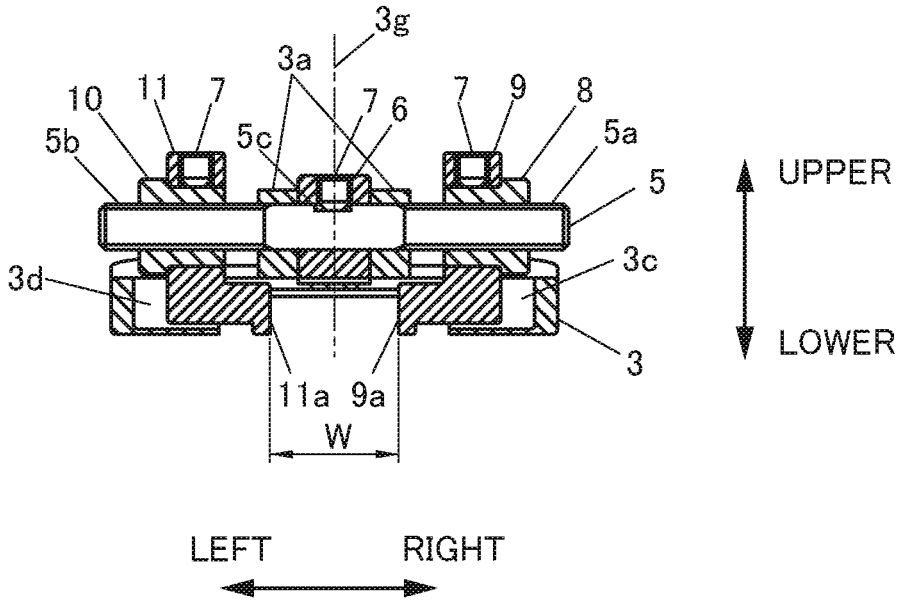
FIG. 4 is a cross-sectional view taken along a line indicated by the arrows B shown in FIG. 2.

FIG. 4 is a cross-sectional view taken along a line indicated by the arrows B shown in FIG. 2.

With the presser foot 100 having the aforementioned configuration, a ribbon inserted into the ribbon insertion window 3*b* is guided by the guide portions 9*a* and 11*a* to a position (roughly at a center portion of the presser main body 1) at which the sewing needle 12 moves in the vertical direction.

Specifically, the right male screw 5*a* and the left male screw 5*b* are respectively formed in both ends of the adjustment screw 5. Thus, by manual rotation of the operation ring 6, such an arrangement is capable of rotating the adjustment screw 5, thereby allowing the right guide 9 and the left guide 11 to be moved symmetrically with respect to the center (needle center) 3*g* of the guide base 3. That is to say, such an arrangement allows the right guide 9 and the left guide 11 to be moved simultaneously outward or otherwise inward, thereby increasing or otherwise reducing the distance between them. The guide portion 9*a* of the right guide 9 and the guide portion 11*a* of the left guide 11 function as guide faces for guiding both sides of the ribbon. That is to say, such an arrangement allows the width W to be controlled.

Figure 5:
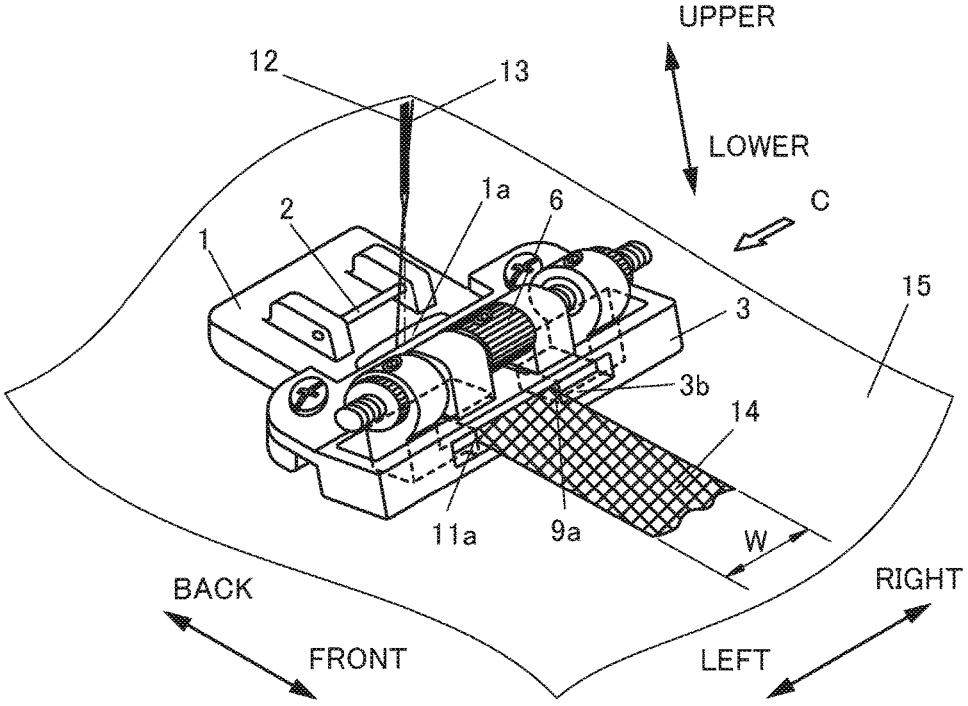
FIG. 5 is a perspective view showing the presser foot 100 in a state in which a ribbon is being sewn.

FIG. 5 is a perspective view showing the presser foot 100 in a state in which a ribbon is being sewn.

Figure 6:
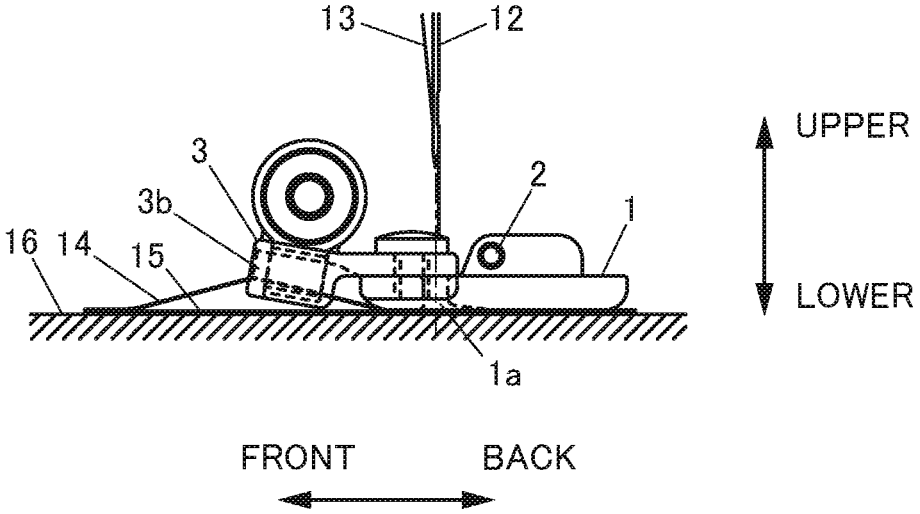
FIG. 6 is a right side view (as viewed from the arrow C in FIG. 5) showing the presser foot 100 in a state in which a ribbon is being sewn.

FIG. 6 is a right side view (as viewed from the arrow C in FIG. 5) showing the presser foot 100 in a state in which a ribbon is being sewn.

A ribbon 14 having the width W, which is controlled by the guide portion 9*a* of the right guide 9 and the guide portion 11*a* of the left guide 11, is inserted into the window 3*b* of the guide base 3. Furthermore, sewing is executed for a cloth 15, which is a sewing target object, on a needle plate 16 by means of the sewing needle 12 through which a thread 13 is threaded. In this state, the position of the ribbon 14 is controlled by means of the guide portions 9*a* and 11*a*. Furthermore, the ribbon 14 is pressed in contact with the cloth 15 by means of the presser main body 1 with a suitable pressure, thereby providing high-precision sewing in a simple manner.

As described above, with the present embodiment, as a guide member, the right guide 9 and the left guide 11 are provided. Furthermore, the adjustment screw 5, the right guide bush 8, and the left guide bush 10 are provided as a linking portion. Such components thus provided are configured as a guide mechanism for guiding a ribbon. Thus, the presser foot 100 according to the present embodiment requires only a rotational operation for the adjustment screw 5 to move the right guide 9 and the left guide 11 in conjunction with each other such that they are positioned symmetrically with the needle position as the base position. Thus, with the presser foot 100 according to the present embodiment, such an arrangement allows the guiding width to be adjusted in a simple manner according to the width of a ribbon (band-shaped member) to be used. In addition, such an arrangement requires no centering adjustment for a ribbon with respect to the needle position.

If such a female screw is directly formed in each of the right guide 9 and the left guide 11, in order to ensure that the center position of the width W matches the position of the sewing needle 12, such an arrangement requires high-precision manufacturing such that the male screw and the female screw have appropriate position phases. In contrast, with the presser foot 100 according to the present embodiment, the right guide 9 and the right guide bush 8 provided with the female screw are configured as separate members. Similarly, the left guide 11 and the left guide bush 10 provided with the female screw are configured as separate members. Thus, such an arrangement allows the guide portion 9*a* of the right guide 9 and the guide portion 11*a* of the left guide 11 to provide, in a simple manner, the position adjustment of the width W to be controlled.

Modification

The present invention is not restricted to such an embodiment described above. Rather, various modifications and changes may be made, which are encompassed within the scope of the present invention.

For example, description has been made with reference to an example in which the guide base 3 is fixed to the the end of the presser main body 1 by means of the clamp screws 4 so as to form a single unit. However, the present invention is not restricted to such an arrangement. For example, a similar structure to the guide base 3 may be provided as a portion of the presser main body itself. That is to say, the presser main body 1 and the guide base 3 may be configured as a single component.

Description has been made with reference to an example using a so-called feed screw mechanism. However, the present invention is not restricted to such an arrangement. For example, a rack-and-pinion mechanism may be employed in the linking portion.

It should be noted that the embodiments and modifications may be mutually combined. However, detailed description thereof will be omitted. Also, the present invention is by no means restricted by the embodiments described above.

DESCRIPTION OF THE REFERENCE NUMERALS

1 presser main body, 1*a* needle opening, 1*b*, screw hole, 1*c* screw hole, 2 pin, 3 guide base, 3*a* boss portion, 3*b* window, 3*c* groove, 3*d* groove, 3*e* hole, 3*f* hole, 3*g* center of guide base 3 (needle center), 4 clamp screw, 5 adjustment screw, 5*a* right male screw, 5*b* left male screw, 5*c* cut face, 6 operation ring, 7 screw, 8 right guide bush, 8*a* right female screw, 9 right guide, 9*a* guide portion, 9*b* through hole, 10 left guide bush, 10*a* left female screw, 11 left guide, 11*a* guide portion, 11*b* through hole, 12 sewing needle, 13 thread, 14 ribbon, 15 cloth, 16 needle plate, 100 presser foot.

What is claimed is:

1. A presser foot for a sewing machine comprising:

a presser main body that presses a sewing target object;

a guide base provided to the presser main body so as to form a single unit, and configured to guide a band-shaped member to be sewn to the sewing target object;

guide members configured as a pair of members that are provided such that they can be relatively moved with respect to the guide base, that guide a position of the band-shaped member in a width direction, and that are arranged symmetrically with a position at which a sewing needle moves in a vertical direction as a base position; and a linking portion that links movements of the guide members such that a distance between the guide members is increased or reduced while the guide members are maintained to be positioned symmetrical to each other with respect to the base position.

2. The presser foot for a sewing machine according to claim 1, wherein the linking portion comprises:

a male screw member configured such that a right male screw is formed in one end thereof, and such that a left male screw is formed in the other end thereof;

a right female screw provided to one of the guide members, and configured to be joined to the right male screw; and a left female screw provided to the other one of the guide members, and configured to be joined to the left male screw.

3. The presser foot for a sewing machine according to claim 2, wherein the right female screw and the left female screw are each configured as a component separate from the guide members, as a separate female screw member, and wherein each female screw member is applied to the corresponding guide member so as to form a single unit, thereby providing the right female screw and the left female screw to the corresponding guide members.

* * * * *